US006557300B1

(12) United States Patent
Bantle

(10) Patent No.: US 6,557,300 B1
(45) Date of Patent: May 6, 2003

(54) PROPPING SUPPORT FOR A CHEST

(75) Inventor: Ulrich Bantle, Empfingen (DE)

(73) Assignee: Karl Simon GmbH & Co. KG, Aichhalden (DE)

( * ) Notice: Subject to any disclaimer, the term of this patent is extended or adjusted under 35 U.S.C. 154(b) by 0 days.

(21) Appl. No.: 09/566,884

(22) Filed: May 8, 2000

(30) Foreign Application Priority Data

May 7, 1999 (DE) ..... 199 20 910
Oct. 22, 1999 (DE) ..... 199 50 970

(51) Int. Cl.[7] ..... E05F 3/00
(52) U.S. Cl. ..... 49/137; 16/65; 16/70
(58) Field of Search ..... 49/381, 386, 246, 49/501, 324, 327, 328, 137; 16/49, 66, 69, 70, 65, 85; 267/212, 216, 249

(56) References Cited

U.S. PATENT DOCUMENTS 1,574,340 A * 2/1926 Fauser
1,731,561 A * 10/1929 Campbell et al.
2,650,386 A * 9/1953 Edwards
2,657,419 A * 11/1953 Wendt
2,836,844 A * 6/1958 May
3,214,787 A * 11/1965 Pierie
4,048,695 A * 9/1977 Juilfs et al. ..... 16/65
4,190,926 A * 3/1980 Cronin ..... 16/65
4,438,544 A * 3/1984 Waldo et al. ..... 16/85
4,639,969 A * 2/1987 Obenshain ..... 16/70

* cited by examiner

*Primary Examiner*—Curtis A. Cohen
(74) *Attorney, Agent, or Firm*—Pauley Peterson Kinne & Erickson

(57) ABSTRACT

A propping support for a chest, having a lid rest fastened on an inside surface of the lid of a chest, and a wall rest connected with the body of the chest. The lid rest and the wall rest are connected by a support device which secures the lid of the chest in a flipped-open position. To improve operational safety, the propping support has a spring holder with a spring element. An actuating element, which is prestressed by a spring against the spring element, can be displaced in a guide between two tilt positions of the chest lid when the lid of the chest is closed. The lid rest and the wall rest are coupled to the spring holder by swivel bearings.

12 Claims, 3 Drawing Sheets

PROPPING SUPPORT FOR A CHEST

BACKGROUND OF THE INVENTION

1. Field of the Invention

This invention relates to a propping support for a chest, having a lid rest fastened on an inside of the lid of a chest, and a wall rest connected with a body of the chest, wherein the lid rest and the wall rest are connected by a support device which secures the lid of the chest in a flipped-open position.

2. Description of Related Art

In a propping support, one support rod is connected with the lid rest and another with the wall rest. The rods are connected together at their free ends via a hinge and a locking mechanism. With the chest lid open, the support rods are arranged in a position stretched toward each other. The locking mechanism prevents the chest from being closed. After the locking mechanism is released, the lid can be flipped down and the two support rods are moved toward each other with a scissor-like movement. While closing the chest there is a danger of crushing between the two support rods. Moreover, with these propping supports the chest lid drops in an uncontrolled manner if it slips out of the hand, in the course of which injuries can also occur.

SUMMARY OF THE INVENTION

It is one object of this invention to provide a propping support of the type mentioned at the outset, wherein the danger of an injury when the chest lid is operated is considerably reduced.

According to this invention, a propping support has a spring holder with a spring element. An actuating element, which is prestressed by a spring against the spring element, can be displaced in a guide between the two tilt positions of the chest lid when the lid of the chest is closed. The lid rest and the wall rest are coupled to the spring holder by swivel bearings.

With this embodiment, the lid rest and the wall rest are uncoupled from each other by means of the spring holder. This uncoupling assures that no scissor-like overlapping of components occurs when closing the chest lid and thus the crushing danger is considerably reduced. Because the chest list is closed against the force of the spring element, the weight of the chest lid can be cancelled, or at least reduced. This prevents the chest lid from having a potential to fall down in an uncontrolled manner during closing.

If the spring holder has a housing, into which the spring element and the actuator are inserted, the housing has a passage, through which the lid rest reaches into the interior of the housing, and the lid rest is connected to the actuator by a swivel bearing in the interior of the housing, then a possible danger of injury by the spring element is also reliably prevented.

In one embodiment of this invention, the spring holder has one or several guides embodied as slits or grooves, which are engaged by guide shoulders of the actuator.

To prevent the chest lid from performing a snapping closing movement aided by the spring element shortly before reaching its closed position, a propping support can be made so that the spring holder has a projection which is connected to the wall rest by means of a swivel bearing. The projection of the swivel bearing holds in the direction of the gravitational force below a connecting line formed between the hinge of the chest lid and the swivel bearing of the lid rest.

If the swivel bearing of the lid and/or the wall rest have spacers, which maintain the swivel bearing at a distance with respect to the inside of the chest lid and/or the inside of the chest wall, then no locations which hold the danger of injuries are created in transition areas between the spring holder and the chest lid, or respectively the chest wall.

In accordance with one preferred embodiment of this invention, the spring element is embodied as a helical spring, which is inserted in the housing of the spring holder, designed as a tube. The interior diameter of the tube is matched to the exterior diameter of the spring element. Thus the tube prevents the kinking of the spring element.

If the wall rest is fastened on the hinge side of the chest wall by the wall rest, it is possible to arrange the wall rest at a distance from the further chest wall adjoining the hinge side of the chest wall.

BRIEF DESCRIPTION OF THE DRAWINGS

This invention is explained in greater detail in what follows by exemplary embodiments represented in the drawings wherein.

DETAILED DESCRIPTION OF PREFERRED EMBODIMENTS

Figure 1:
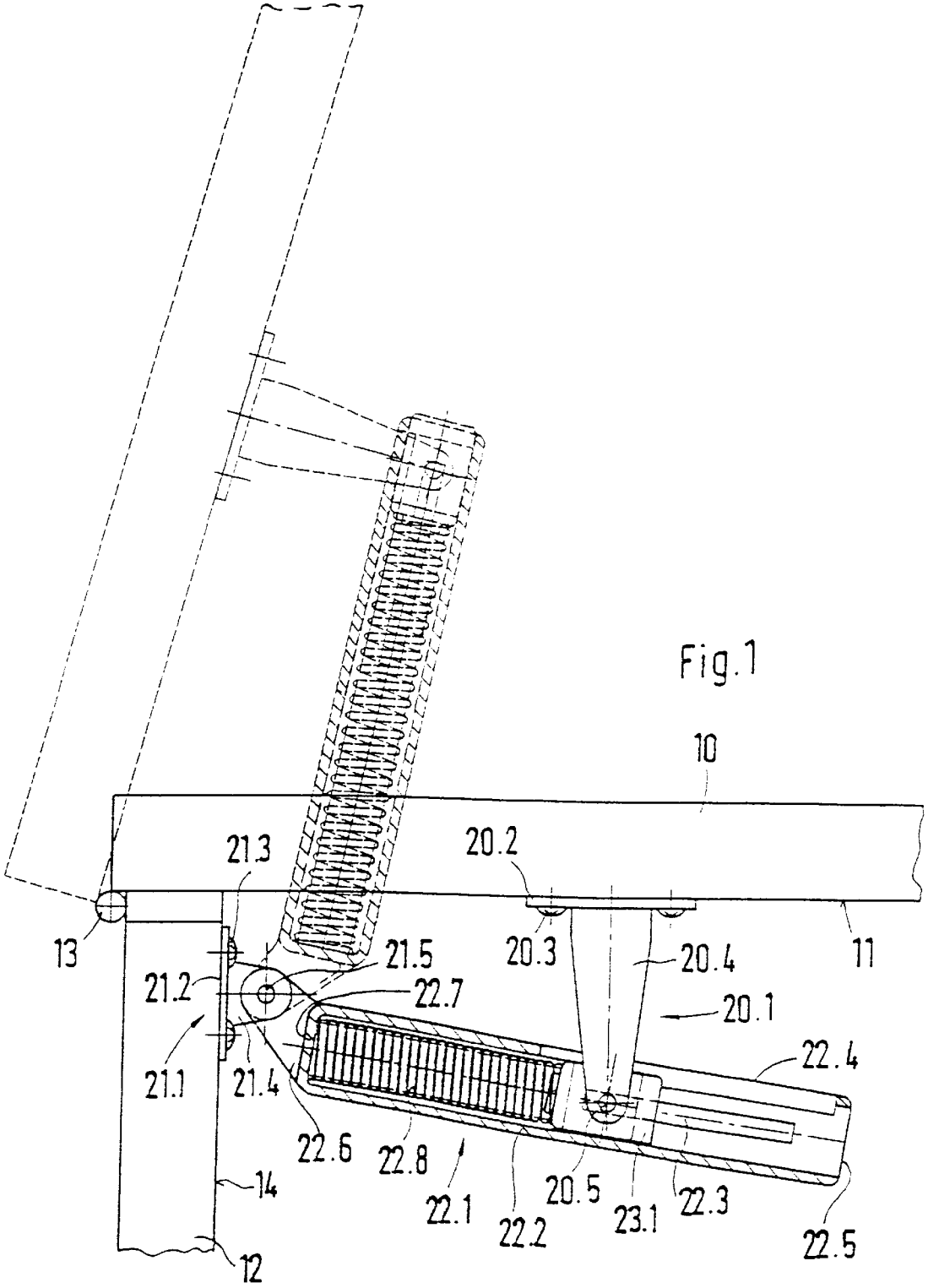
FIG. 1 is a schematic side view of a chest, on which a propping support is fastened.

The chest has a furniture body with a rear chest wall 12. A chest lid 10 is connected by means of a strap hinge 13 to the chest wall. The chest lid 10 is shown in the closed and opened positions. In the opened position, shown in FIG. 1 by the dashed lines, the chest lid 10 can be secured against dropping by a propping support.

The propping support is installed on the chest lid 10 by means of a lid rest 20.1, and on the chest wall 12 by means of a wall rest 21.1. The lid rest 20.1 and the wall rest 21.1 are basically constructed in the same way and essentially differ by their dimensions. Both can be produced of stamped and bent elements from a sheet steel blank. They have a fastening plate 20.2, 21.2, which is attached by fastening means 20.3, 21.3 on an inside surface 11 of the lid, or respectively an inside surface 14 of the chest wall 12. A tab-shaped spacer 20.4, 21.4 is bent at right angles from the fastening plate 20.2, 21.2. The spacer 20.4, 21.4 has a bearing lug to form a swivel bearing 20.5, 21.5.

A support device 22.1 with a spring holder 22.2 is attached to the lid rest 20.1 and the wall rest 21.1.

The spring holder 22.2 has a tube-shaped receptacle housing, which has a pointed projection 22.6 on the side toward the chest wall. The projection 22.6 has a bearing lug which with a hinge bolt and the wall rest 21.1 forms the swivel bearing 21.5.

A spring element 22.8, embodied as a helical pressure spring, is contained in the tube-shaped housing. The housing has a cylinder-shaped inner receptacle accessible via an insertion opening 22.5, through which the spring element 22.8 can be inserted. On one end, the spring element 22.8 is supported on a support element 22.7 of the spring holder 22.2. The support element 22.7 limits the tube-shaped housing in the area of the projection 22.6.

The interior of the spring holder 22.2 is accessible through a slit-shaped passage 22.4. The lid rest 20.1 extends with its spacer 20.4 through the passage 22.4. In the interior of the housing, the bearing lug of the spacer 20.4 is connected with an actuator 23.1 and forms a swivel bearing 20.5. The actuator 23.1 is guided, linearly displaceable, in the spring holder 22.2 and is supported on one end against the spring element 22.8. To assure a tilt-free guidance of the spring element 22.8, a guide 22.3 is recessed in the spring holder 22.2. The actuator 23.1 engages the guide with a laterally extending guide protrusion. The guide limits the displacement movement of the actuator 22.2 at the respective ends of the guide.

Figure 2:
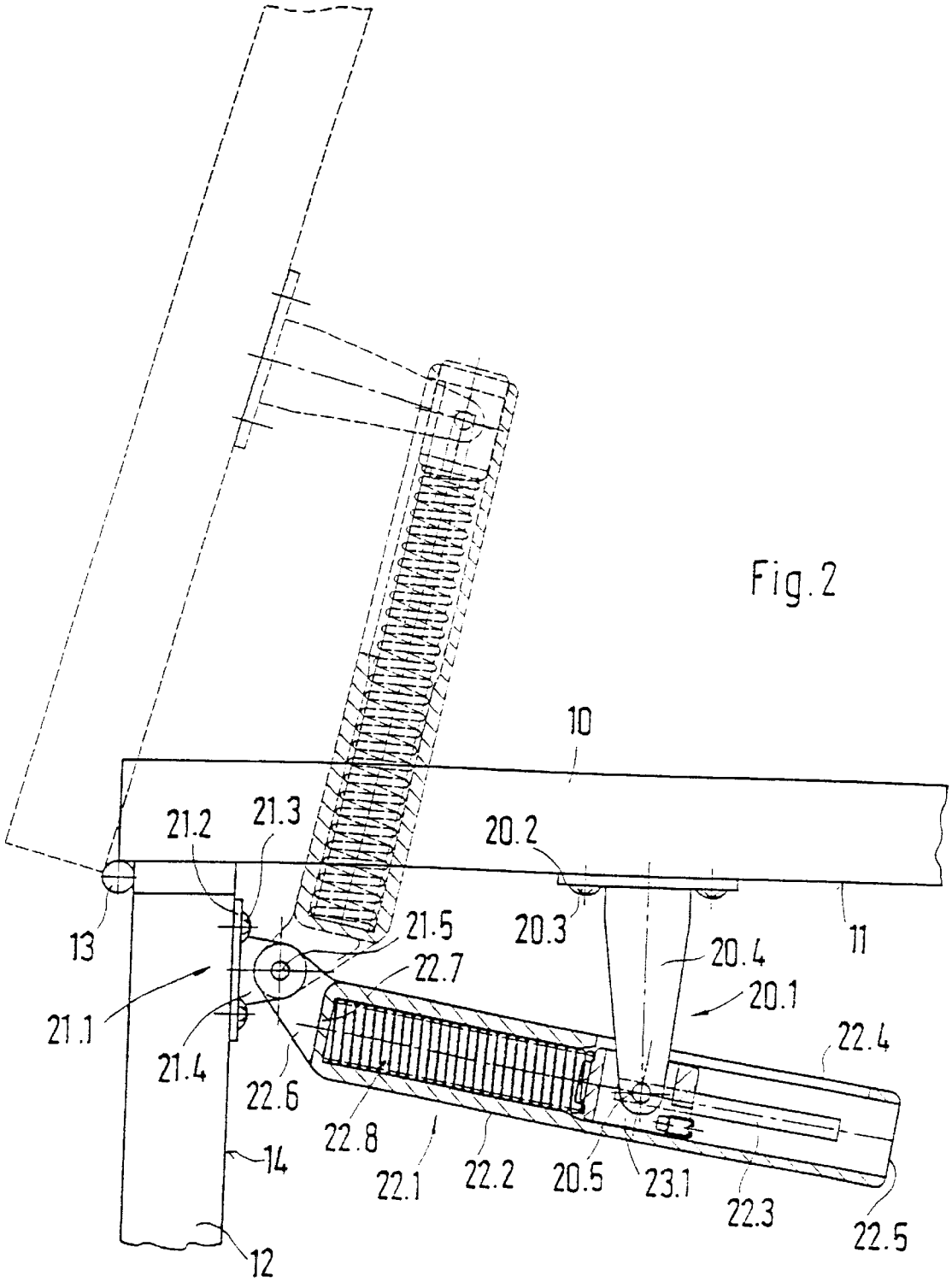
FIG. 2 is a schematic view of the embodiment in accordance with FIG. 1, but with a different propping support.
Figure 3:
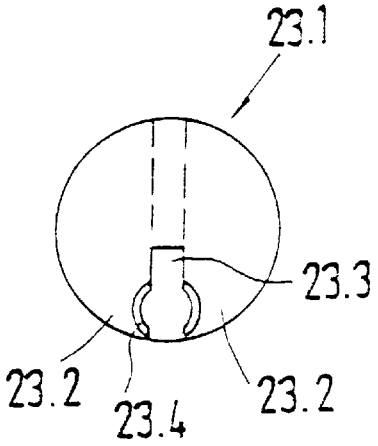
FIG. 3 is a front view of an actuator of the propping support shown in FIG. 2.
Figure 4:
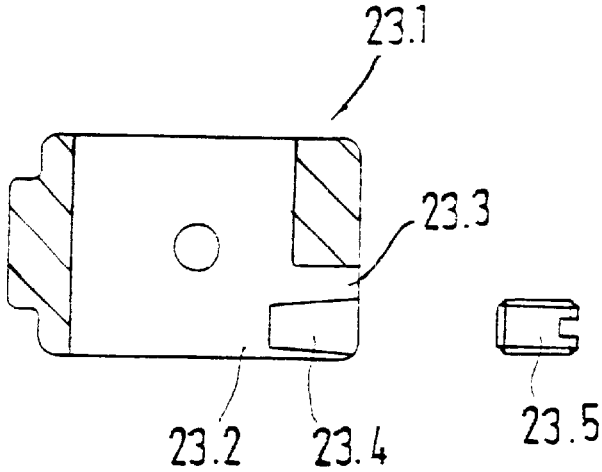
FIG. 4 is a side sectional view of the actuator shown in FIG. 3.

Another embodiment of a propping support is shown in FIG. 2. With this propping support the spring element 22.8, which is embodied as a helical compression spring, is of such dimensions that its exterior diameter rests against the inner wall of the spring holder 22.2 in the tensed state. Thus a braking effect is achieved when the chest lid 10 is kept in the closed state. An unintended snapping-open of the chest lid 10 can thus be prevented. The unintended snapping-open of the chest lid 10 can also be achieved by means of the modified actuator 23.1 shown in FIG. 2. The modified actuator 23.1 can be more clearly seen in FIGS. 3 and 4. A longitudinal slit 23.3 is cut into the actuator 23.1. The longitudinal slit 23.3 divides the actuator 23.1 into two legs 23.2. A threaded receiver 23.4 is arranged in the area of the longitudinal slit 23.3. The rising threads of the threaded receiver 23.4 are in both legs 23.2. If a screw 23.5 is screwed into the threaded receiver 23.4, the two legs 23.2 spread apart with respect to each other. The actuator 23.1 then clampingly rests against the inner contour of the spring holder 22.2 in an outer area adjoining the legs 23.2. It is thus possible, by these steps, to prevent the lid from springing open unintentionally. A braking effect is introduced, which also prevents the chest lid 10 from slamming shut.

In the embodiment of the support device 22.1 with the chest lid 10 closed, the spring element 22.8 is prestressed to block length or nearly to block length. The actuator 23.1 is displaced into one of its extreme positions. While opening the chest lid 10, the spring element 22.8 relaxes continuously. In the process the spring force partially cancels the weight of the chest lid 10. In the opened position, representation in dashed lines, the chest lid 10 is securely held by means of the remaining spring tension provided and is secured against being shut unintentionally. The opening movement is limited by the actuator 23.1, which stops against the end of the guide 22.3. For closing the chest lid 10 it is necessary to exert a force, which then acts against the spring force, so that the latter is compressed. To prevent a snapping movement of the chest lid 10 shortly before reaching the closed position, the hinge axis, which is formed by the swivel bearing 21.5, is always maintained, viewed in the direction of the gravitational force, below the connecting line between the axis of the hinge and the pivot axis of the swivel bearing 20.5, prior to dead center.

I claim:

1. In a propping support for a chest, having a lid rest fastened on an inside surface of a lid of the chest, and a wall rest connected with a body of the chest, wherein the lid rest and the wall rest are connected by a support device which secures the lid of the chest in an open position, the improvement comprising:

the support device (22.1) having a spring holder (22.2);

an actuating element (23.1) prestressed against the spring element (22.8) displaceable in a guide (22.3) between two positions; and the lid rest (20.1) coupled to the actuating element (23.1) by a swivel bearing (20.5) and the wall rest (21.1) coupled to the spring holder (22.2) by a second swivel bearing (21.5).

2. In the propping support in accordance with claim 1, wherein the lid rest (20.1) is connected by the swivel bearing (20.5) to the actuating element (23.1) in the interior of the housing.

3. In the propping support in accordance with claim 2, wherein the spring holder (22.2) has the guide (22.3) embodied as one of a slit and a groove which is engaged by guide shoulders of the actuator (23.1).

4. In the propping support in accordance with claim 3, wherein the spring holder (22.2) has a first projection (22.6) which is connected to the wall rest (21.1) by the second swivel bearing (21.5), and a second projection of the second swivel bearing (21.5) holds in a direction of gravitational force below a connecting line between a hinge (13) of the chest lid (10) and the swivel bearing (20.5) of the lid rest (20.1).

5. In the propping support in accordance with claim 4, wherein at least one of the swivel bearing (20.5) of the lid rest (20.1) and the second swivel bearing (21.5) of the wall rest (21.1) has spacers (20.4, 21.4) which maintain each of the swivel bearing (20.5) and the second swivel bearing (21.5) at a distance with respect to at least one of the inside surface (11) of the chest lid (10) and a second inside surface (14) of the chest wall (12).

6. In the propping support in accordance with claim 5, wherein the spring element (22.8) is embodied as a helical spring which is inserted in a housing of the spring holder (22.2) embodied as a tube, and an interior diameter of the tube corresponds to an exterior diameter of the spring element (22.8).

7. In the propping support in accordance with claim 6, wherein the wall rest (21.1) is fastened on a hinge side of the chest wall (12) by the wall rest (21.1).

8. In the propping support in accordance with claim 1, wherein the spring holder (22.2) has the guide (22.3) embodied as one of a slit and a groove which is engaged by guide shoulders of the actuator (23.1).

9. In the propping support in accordance with claim 1, wherein the spring holder (22.2) has a first projection (22.6) which is connected to the wall rest (21.1) by the second swivel bearing (21.5), and a second projection of the second swivel bearing (21.5) holds in a direction of gravitational force below a connecting line between a hinge (13) of the chest lid (10) and the swivel bearing (20.5) of the lid rest (20.1).

10. In the propping support in accordance with claim 1, wherein at least one of the swivel bearing (20.5) of the lid rest (20.1) and the second swivel bearing (21.5) of the wall rest (21.1) has spacers (20.4, 21.4) which maintain each of the swivel bearing (20.5) and the second swivel bearing (21.5) at a distance with respect to at least one of the inside surface (11) of the chest lid (10) and a second inside surface (14) of the chest wall (12).

11. In the propping support in accordance with claim 1, wherein the spring element (22.8) is embodied as a helical spring which is inserted in a housing of the spring holder (22.2) embodied as a tube, and an interior diameter of the tube corresponds to an exterior diameter of the spring element (22.8).

12. In the propping support in accordance with claim 1, wherein the wall rest (21.1) is fastened on a hinge side of the chest wall (12) by the wall rest (21.1).

* * * * *